US006213202B1

(12) United States Patent
Read, Jr.

(10) Patent No.: US 6,213,202 B1
(45) Date of Patent: Apr. 10, 2001

(54) SEPARABLE CONNECTOR FOR COIL TUBING DEPLOYED SYSTEMS

(75) Inventor: Dennis M. Read, Jr., Houston, TX (US)

(73) Assignee: Camco International, Inc., Houston, TX (US)

( * ) Notice: Subject to any disclaimer, the term of this patent is extended or adjusted under 35 U.S.C. 154(b) by 0 days.

(21) Appl. No.: 09/158,434

(22) Filed: Sep. 21, 1998

(51) Int. Cl.[7] ..... E21B 23/00; E21B 23/04

(52) U.S. Cl. ..... 166/55.1; 166/65.1; 166/106; 166/242.2; 166/242.6; 166/317; 166/375; 166/376; 137/65.15; 285/3

(58) Field of Search ..... 166/55.1, 65.1, 166/68, 105, 106, 242.2, 242.6, 317, 375, 376, 377, 384, 386; 137/68.14, 68.15; 285/3

(56) References Cited

U.S. PATENT DOCUMENTS

| | | | | |
|---|---|---|---|---|
| 2,230,830 | * | 2/1941 | Coberly | 166/377 X |
| 4,516,917 | | 5/1985 | Canalizo | 417/390 |
| 4,753,291 | * | 6/1988 | Smith et al. | 285/3 X |
| 4,913,229 | * | 4/1990 | Hearn | 285/3 X |
| 4,921,438 | | 5/1990 | Godfrey et al. | 439/190 |
| 4,976,317 | | 12/1990 | Leismer | 166/321 |
| 5,323,853 | | 6/1994 | Leismer et al. | 166/55 |
| 5,417,291 | * | 5/1995 | Leising | 166/184 X |
| 5,419,399 | | 5/1995 | Smith | 166/377 |
| 5,425,420 | | 6/1995 | Pringle . | |
| 5,568,836 | * | 10/1996 | Reid | 166/65.1 |
| 5,699,858 | * | 12/1997 | McAnally | 166/382 |
| 5,746,582 | * | 5/1998 | Patterson | 166/377 X |
| 5,810,088 | * | 9/1998 | Lamirand et al. | 166/242.6 X |
| 5,865,250 | * | 2/1999 | Gariepy | 166/375 |
| 5,947,198 | * | 9/1999 | McKee et al. | 166/377 X |
| 5,984,006 | * | 11/1999 | Read et al. | 166/242.6 X |

FOREIGN PATENT DOCUMENTS 0 624 709 A2 11/1994 (EP) .

* cited by examiner

*Primary Examiner*—George Suchfield
(74) *Attorney, Agent, or Firm*—Fletcher, Yoder & Van Someren

(57) ABSTRACT

A connector permits separation of a submergible pumping system from its deployment system. The connector includes an upper assembly and a lower assembly that are connected by shear screws. A hydraulic separation mechanism is used to shear the shear screws and separate the upper and lower assemblies from a remote location.

15 Claims, 7 Drawing Sheets

SEPARABLE CONNECTOR FOR COIL TUBING DEPLOYED SYSTEMS

FIELD OF THE INVENTION

The present invention relates generally to the field of submergible equipment, such as pumping systems, for use in wells, such as petroleum production wells, and other submerged environments. More particularly, the invention relates to an apparatus for coupling a deployment system, such as coil tubing, to deployed equipment, such as a submergible pumping system.

BACKGROUND OF THE INVENTION

In producing petroleum and other useful fluids from production wells, a variety of component combinations, sometimes referred to as completions, are used in the downhole environment. For example, it is generally known to deploy a submergible pumping system in a well to raise the production fluids to the earth's surface.

In this latter example, production fluids enter the wellbore via perforations formed in a well casing adjacent a production formation. Fluids contained in the formation collect in the wellbore and are raised by the submergible pumping system to a collection point above the surface of the earth. In an exemplary submergible pumping system, the system includes several components such as a submergible electric motor that supplies energy to a submergible pump. This system may further include additional components, such as a motor protector, for isolating the motor oil from well fluids. A connector also is used to connect the submergible pumping system to a deployment system. These and other components may be combined in the overall submergible pumping system.

Conventional submergible pumping systems are deployed within a wellbore by a deployment system that may include tubing, cable or coil tubing. Power is supplied to the submergible electric motor via a power cable that runs along the deployment system. For example, with coil tubing, the power cable is either banded to the outside of the coil tubing or disposed internally within the hollow interior formed by the coil tubing. Additionally, other control lines, such as hydraulic control lines and tubing encapsulated conductors (TECs) may extend along or through the deployment system to provide a variety of inputs or communications with various components of the completion.

When an electric submergible pumping system is deployed in a well, it often is convenient to utilize coil tubing to support the completion equipment and to channel power and other conductors, particularly when production fluids are located a substantial distance beneath the earth's surface. However, the weight of the coil tubing, power cable, any fluid within the coil tubing, control lines and completion equipment determines the length of coil tubing that can support the completion in the well, eventually reaching the material strength limit of the tubing. Accordingly, it is desirable to minimize forces associated with deploying and retrieving a completion, so that the coil tubing may be deployed to maximum depth without risking damage to the coil tubing or power cable.

For removal of the completion from the well, such factors must be considered as adding to the load which will be exerted on the deployment system. Other loads are also encountered upon retrieval. For example, a coil tubing deployment system may be filled with an internal fluid to provide buoyancy to the power cable running therethrough. However, the "loaded" coil tubing cannot be extended as far into a well as an unloaded coil tubing deployment system, because the weight of the internal fluid places additional force on the coil tubing. The fluid also adds to the load borne by the deployment system upon retrieval. Other forces and loads may result from drag within the wellbore (such as due to integral packers and similar structures), accumulated sand or silt, rock or aggregate fall-ins, and so forth. To provide for such loads, the deployment system is generally overdesigned or the completion is positioned substantially higher in the well than the mechanical strength limits of the deployment system would otherwise dictate.

When a submergible pumping system is deployed to substantial depth relative to the strength of the coil tubing, it has been proposed to release the completion and remove the coil tubing from the well separately from the completion. A work string, such as a high tensile strength coil tubing with a fishing tool, is then run downhole and latched to the completion for removal. Conventionally, submergible pumping systems have been separated from the coil tubing at the connector used to connect the coil tubing to the completion. Conventional connectors had separable components connected by shear pins or other frangible structures. Thus, to release the deployment system from the submergible pumping system, sufficient force was exerted on the deployment system to shear the pins. However, the strength to withstand the additional load required to produce this shear force must also be built into the deployment system. Moreover, this additional load potentially can damage the coil tubing and power cable. To avoid such damage, the length of the coil tubing must again be reduced to correspondingly reduce the weight supported in the wellbore. Such limits on the depth to which the submergible pumping system can be deployed are undesirable.

It would be advantageous to have a remotely actuated separation technique for releasing a deployment system from a completion, e.g. submergible pumping system, without placing undue added forces on the deployment system during the separation operation. Such a technique for separating the deployment system from the completion would facilitate placement of the completion at greater depth within the wellbore without otherwise changing the deployment system or submergible components.

SUMMARY OF THE INVENTION

The present invention features an apparatus for connecting a submergible pumping system to a deployment system and for selectively releasing the submergible pumping system from the deployment system. In a favored configuration the system comprises a coil tubing deployment system and a downhole completion. The coil tubing deployment system is connected to the downhole completion by a connector. The connector includes an upper connector assembly and a lower connector assembly. The upper and lower connector assemblies are attached to one another. Additionally, the connector includes a separator mechanism configured for remote actuation that selectively separates the upper connector assembly from the lower connector assembly. The arrangement may be underbalanced or pressure biased into an engaged position to provide additional control on the release of the completion. The entire assembly may be field installed in a straightforward manner, thereby facilitating initial installation and deployment.

According to another aspect of the invention, a connector is provided for connecting a downhole completion to a deployment system. The connector comprises an upper connector assembly and a lower connector assembly attached thereto. The connector further includes a pressure chamber disposed between the upper connector assembly and the lower connector assemblies. A fluid line is disposed in fluid communication with the pressure chamber. Additionally, a check valve is connected to the fluid line. The check valve permits flow of fluid to the pressure chamber to separate the upper connector from the lower connector but prevents backflow through the fluid line after separation.

According to another aspect of the invention, a connector is provided for use in deploying a downhole completion. The connector includes an upper assembly and a lower assembly. A shear mechanism connects the upper assembly to the lower assembly. A plurality of conductors extend through the upper and lower assembly. Those conductors are connected across a plug having a first plug portion and a second plug portion. The connector also includes a remotely controlled separation mechanism able to simultaneously shear the shear mechanism and separate the first plug portion from the second plug portion.

BRIEF DESCRIPTION OF THE DRAWINGS

The invention will hereafter be described with reference to the accompanying drawings, wherein like reference numerals denote like elements, and.

DETAILED DESCRIPTION OF THE PREFERRED EMBODIMENTS

Figure 1:
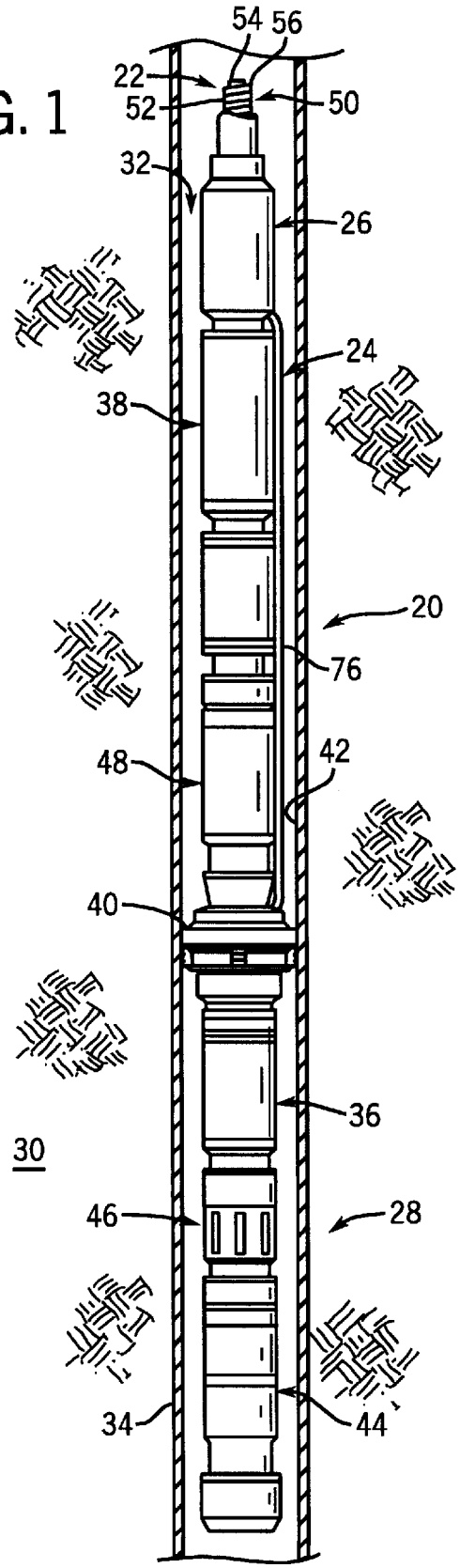
FIG. 1 is a front elevational view of a submergible pumping system positioned in a wellbore, according to a preferred embodiment of the present invention.

Referring generally to FIG. 1, a system 20 is illustrated according to a preferred embodiment of the present invention. System 20 may comprise a variety of components depending upon the particular application or environment in which it is used. However, system 20 typically includes a deployment system 22 connected to a completion, such as an electric submergible pumping system 24. Deployment system 22 is attached to pumping system 24 by a connector 26.

System 20 is designed for deployment in a well 28 within a geological formation 30 containing fluids, such as petroleum and water. In a typical application, a wellbore 32 is drilled and lined with a wellbore casing 34. The submergible pumping system 24 is deployed within wellbore 32 to a desired location for pumping wellbore fluids.

As illustrated, pumping system 24 typically includes at least a submergible pump 36 and a submergible motor 38. Submergible pumping system 24 also may include other components. For example, a packer assembly 40 may be utilized to provide a seal between the string of submergible components and an interior surface 42 of wellbore casing 34. Other additional components may comprise a thrust casing 44, a pump intake 46, through which wellbore fluids enter pump 36, and a motor protector 48 that serves to isolate the wellbore fluid from the motor oil. Still further components, and various configurations, may be provided depending on the characteristics of the formation and the type of well into which the completion is deployed.

In the preferred embodiment, deployment system 22 is a coil tubing system 50 utilizing a coil tube 52 attached to the upper end of comnector 26. A power cable 54 runs through the hollow center of coil tube 52. Power cable 54 typically comprises three conductors for providing power to motor 38. Additionally, at least one control line 56 preferably runs through coil tube 52 to provide input for initiating separation of connector 26 from a remote location, as will be described in detail below. Additional lines, such as fluid or conductive control lines may run through the hollow interior of coil tube 52. Also, other types of deployment systems may be utilized with connector 26.

Figure 2:
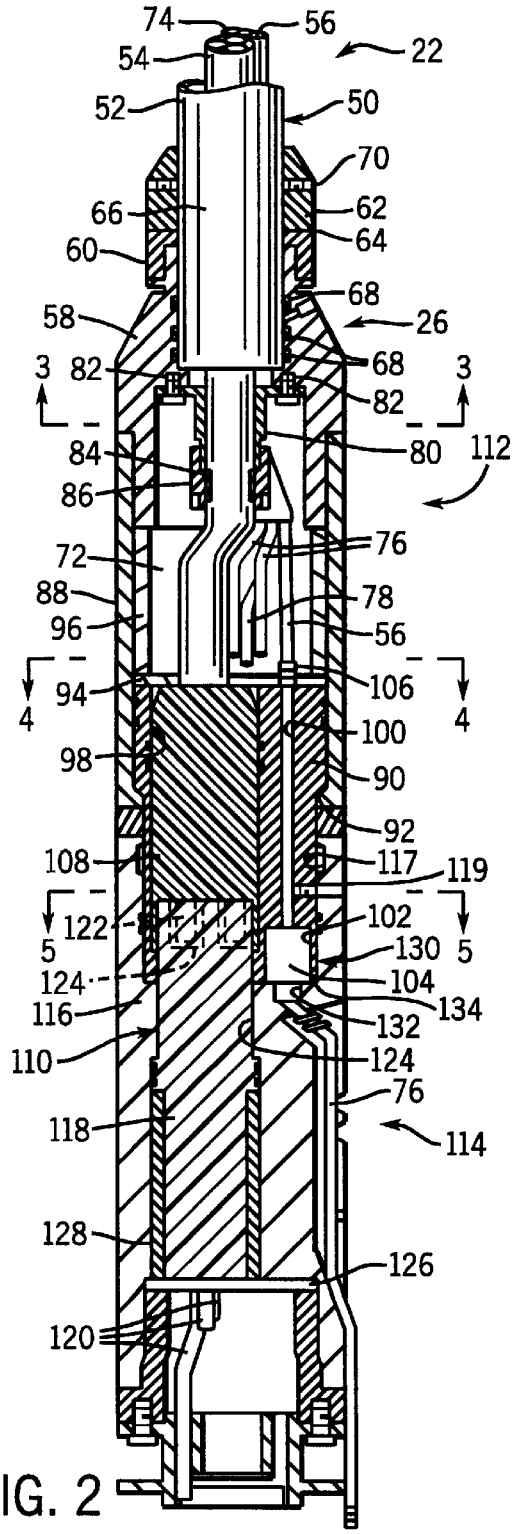
FIG. 2 is a cross-sectional view of a connector, generally along its longitudinal axis according to a preferred embodiment of the present invention.

Referring generally to FIG. 2, a cross-sectional view of connector 26 is taken generally along its longitudinal axis. The illustrated connector 26 is a preferred embodiment of a separable connector. However, a variety of connector configurations can be utilized with the present inventive system and method. Accordingly, the present invention should not be limited to the specific details described.

With reference to FIG. 2, connector 26 includes an upper connector head 58 having an upper threaded region 60. A slip nut 62 is threadably engaged with threaded region 60. Slip nut 62 cooperates with connector head 58 and a retaining slip 64 to securely grip a lower end 66 of coil tubing 52. A plurality of seals 68 are disposed between connector head 58 and coil tubing 52. Additionally, a plurality of dimpling screws 70 are threaded through slip nut 62 in a radial direction for engagement with lower end 66 of coil tubing 52.

In the illustrated embodiment, power cable 54 extends through the center of coil tubing 52 into a hollow interior 72 of connector 26. Additionally, a flat pack 74, including control line 56, also extends through the center of coil tubing 52 into hollow interior 72. Flat pack 74 further includes, for example, a pair of fluid lines 76 and a conductive control line 78, such as a tubing encapsulated conductor, or TEC.

Figure 3:
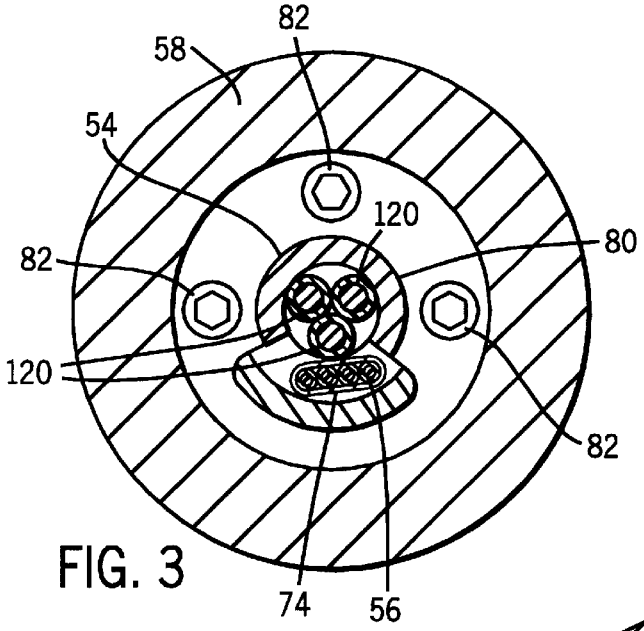
FIG. 3 is a cross-sectional view taken generally along line 3—3 of FIG. 2.

Power cable 54 is held within hollow interior 72 by an anchor base 80 attached to connector head 58 by a plurality of fasteners 82, such as threaded bolts, as illustrated in FIGS. 2 and 3. Additionally, an anchor slip 84 is disposed about power cable 54 and secured by an anchor nut 86 threadably engaged with anchor base 80.

Figure 4:
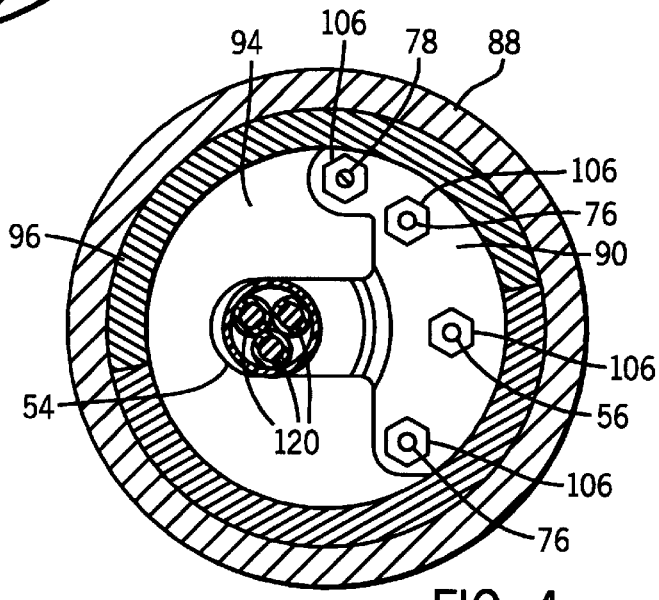
FIG. 4 is a cross-sectional view taken generally along line 4—4 of FIG. 2.

An upper housing 88 is threadably engaged with connector head 58. A hydraulic manifold 90 is disposed within upper housing 88 and held between a lower internal ridge 92 of upper housing 88 and a plate 94 (see also FIG. 4). Plate 94 is held against the upper end of hydraulic manifold 90 by a split sleeve 96 disposed between connector head 58 and plate 94, as illustrated.

Manifold 90 includes a longitudinal opening 98 therethrough. Additionally, manifold 90 includes a plurality of fluid or conductive control line openings 100 extending longitudinally therethrough. Preferably, each opening 100 terminates at a recessed area 102 formed in manifold 90 for receiving a valve 104. Additionally, plate 94 includes an opening through which power cable 54 and control lines 56, 76 and 78 extend into connection with manifold 90 via couplings 106.

Disposed within opening 98 of manifold 90 is an upper plug connector 108 of an overall plug or plug assembly 110. Upper plug connector 108, manifold 90 and the above described components of connector 26 comprise an upper connector assembly 112 designed for separable engagement with a lower connector assembly 114.

Figure 5:
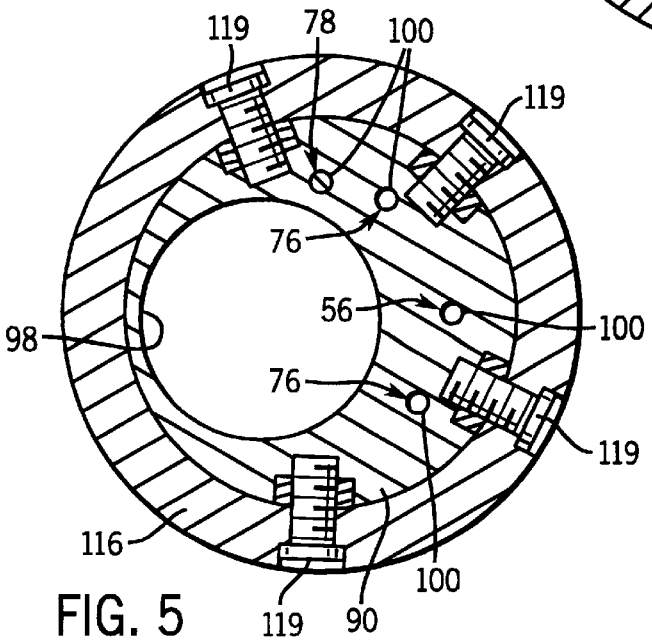
FIG. 5 is a cross-sectional view taken generally along line 5—5 of FIG. 2.

Lower connector assembly 114 includes, for example, a lower housing 116 and a lower plug connector 118 of plug 110. Lower housing 116 and lower plug connector 118 are both designed for attachment to upper connector assembly 112. Specifically, lower housing 116 is designed to receive the lower portion of hydraulic manifold 90. Preferably, housing 116 is further attached to upper connector assembly 112 by a plurality of shear screws 119, or similar controlled release elements, extending radially through lower housing 116 into manifold 90, as illustrated in FIGS. 1 and 5.

Plug assembly 110 also is designed for separable engagement, such that upper plug connector 108 remains with upper connector assembly 112 and lower plug connector 118 remains with lower connector assembly 114 when connector 26 is separated. As illustrated, power cable 54 is routed to upper plug connector 108. The power cable includes a plurality of conductors 120, typically three motor conductors, that are routed through plug assembly 110. Each conductor also is separable along with plug assembly 110. For example, each conductor 120 may have a separation point formed by mating male terminals 122 and female receptacles 124 formed in corresponding portions of plug assembly 110. Conductors 120 are designed to provide power to the completion, and in the illustrated embodiment specifically to motor 38 of the electric submergible pumping system. Thus, the plug assembly permits connector 26 to be used with powered completions without causing damage upon separation of upper connector assembly 112 and lower connector assembly 114. Preferably, lower plug connector 118 is held within a longitudinal opening of lower housing 116 by a lower plate 126 and a support 128. In appropriate applications, a biasing member (not shown) may be provided adjacent to one or both plug connectors to urge the connectors toward electrical engagement. Similarly, hydrostatic pressures in the acting against plate 126 may be used to bias the lower plug connector 118 into engagement with upper plug connector 108.

Figure 6:
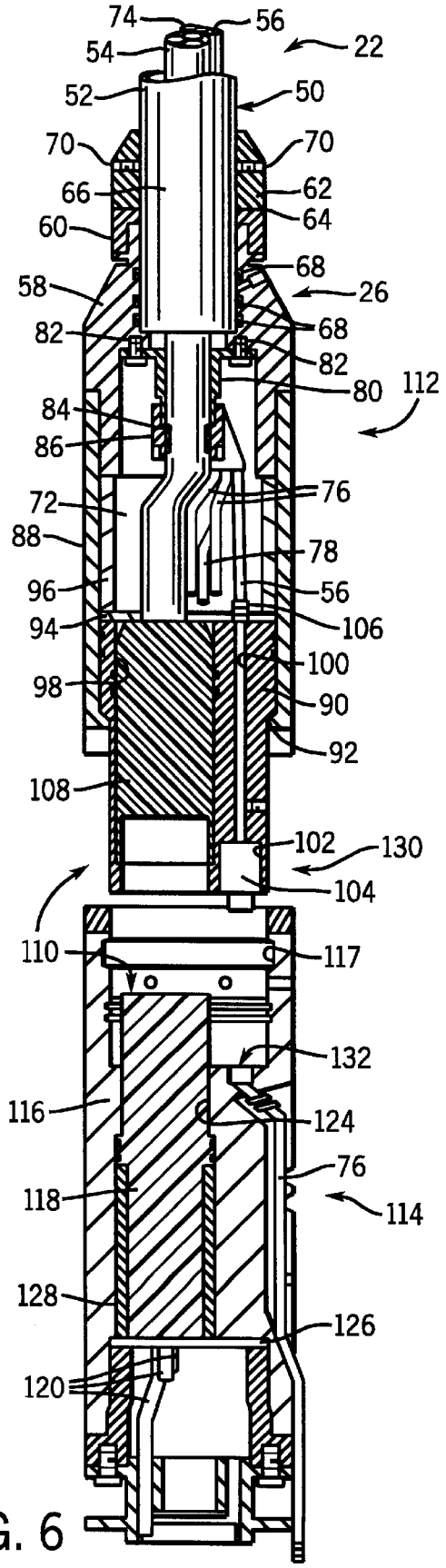
FIG. 6 is a cross-sectional view similar to that of FIG. 2 but showing the connector separated.

Separation of upper connector assembly 112 from lower connector assembly 114 is accomplished by an appropriate separator mechanism. In the preferred embodiment, separator mechanism 130 comprises control line 56, in this case a hydraulic control line, disposed through upper connector assembly 112 and manifold 90. Separator mechanism 130 also includes valve 104 and a fluid discharge area 132 formed on lower housing 116 to create a pressure chamber 134 between upper connector assembly 112 and area 132. For release, pressurized hydraulic fluid is forced through control line 56 from a remote location, such as a control station at the earth's surface, to pressure chamber 134. Valve 104 permits the pressurized fluid to act against fluid discharge area 132 to pressurize pressure chamber 134. Upon sufficient increase in pressure acting between upper connector assembly 112 and lower connector assembly 114, the shear mechanism, e.g. shear screws 119, is sheared. This shearing permits separation of upper connector assembly 112 from lower connector assembly 114, as illustrated in FIG. 6. Simultaneously, upper plug connector 108 of plug assembly 110 is disengaged from lower plug connector 118. Thus, the connector 26 can be separated without placement of any undue force on either coil tubing 52 or power cable 54. Following separation, the preferred embodiment illustrated provides a predicable and uniform surface or surfaces which may be engaged by a fishing tool or similar device for removal of the completion from the well. The surfaces may define various retrieval profiles, either internal or external, such as profile 117 shown in FIGS. 2 and 6.

Also, other separator mechanisms could be incorporated into the present design. For example, an electrical signal could be delivered downhole to a dedicated electric pump connected to and able to pressurize chamber 134.

It should be noted that in the illustrated embodiment, opening 98 is disposed off the axial center of manifold 90. With this embodiment, the shear screws 119 are grouped along the side of the manifold area that receives the greatest portion of the resultant force due to pressurized fluid flowing into pressure chamber 134. Specifically, the placement of four shear screws, as illustrated in FIG. 5, reduces the potential for "cocking" of manifold 90 within lower housing 116, and thereby facilitates separation of assemblies 112 and 114.

Upon separation, valve 104 closes control link 56 to prevent well fluid from contaminating the hydraulic fluid within control line 56, and to prevent wellbore fluids from escaping through the fluid lines. The preferred design and functions of valve 104 are explained in detail below.

Additional valves 104 may be disposed within manifold 90 for the fluid lines 76 as illustrated for control line 56 and as further described below. The use of valves 104 prevents contamination of the fluid control lines 76, that are disposed above lower connector assembly 114. Optionally, valves 104 can be placed in each of the control lines 76 extending along lower connector assembly 114 to prevent contamination of the control lines below upper connector assembly 112 when separated, and to prevent the escape of wellbore fluids. It also should be noted that the fluid line 76 shown beneath such additional valves 104 in FIG. 1, does not enter pressure chamber 134. Rather, it is the continuation of one of the fluid control lines 76 that provide fluid to a desired component, such as packer assembly 40.

In operation, connector 26 is attached to deployment system 22, e.g., coil tubing 52, and to a downhole completion, such as electric submergible pumping system 24. Thereafter, the entire 20 system is deployed in wellbore 32 to the desired depth. In appropriate applications, it may be desirable to lock the upper connector assembly 112 to the lower connector assembly 114 during deployment and potentially during use to avoid accidental disengagement. The connector assemblies can be locked together in a variety of ways depending on the specific design of connector 26. For example, J-slots, supported collet locks, releasable dogs or other appropriate locking mechanisms can be used.

After properly locating the system in the wellbore, packer assembly 40 is set via one of the lines 76, and production fluids are pumped to the surface through the annulus formed around deployment system 22. Preferably, any locking mechanism disposed on connector 26 is released prior to setting packer assembly 40. When it becomes necessary to service or remove pumping system 24, connector 26 is separated to permit removal of coil tubing 52.

The separation process is initiated by pumping hydraulic fluid through control line 56 and valve 104 to fluid discharge area 132. When the fluid pressure in control line 56 and pressure chamber 134 rises to a sufficient level, upper connector assembly 112 begins to separate from lower connector assembly 114 by movement of manifold 90. Upon sufficient movement of manifold 90 with respect to the walls of lower connector assembly 114, pins 119 are sheared, freeing the upper connector assembly to be withdrawn from the lower connector assembly. It should be noted that in the preferred embodiment, the connector plugs, as well as the fluid and electrical control lines remain sealed within their respective portions of the connector following separation. Also, the foregoing arrangement permits the release of the completion via straight-pull shearing of the pins in conjunction with or without hydraulic assistance. It should also be noted that in the present embodiment, the connector system is pressure biased in an engaged condition because the pressure in control line 56 is generally lower than that present in the well.

Figure 7:
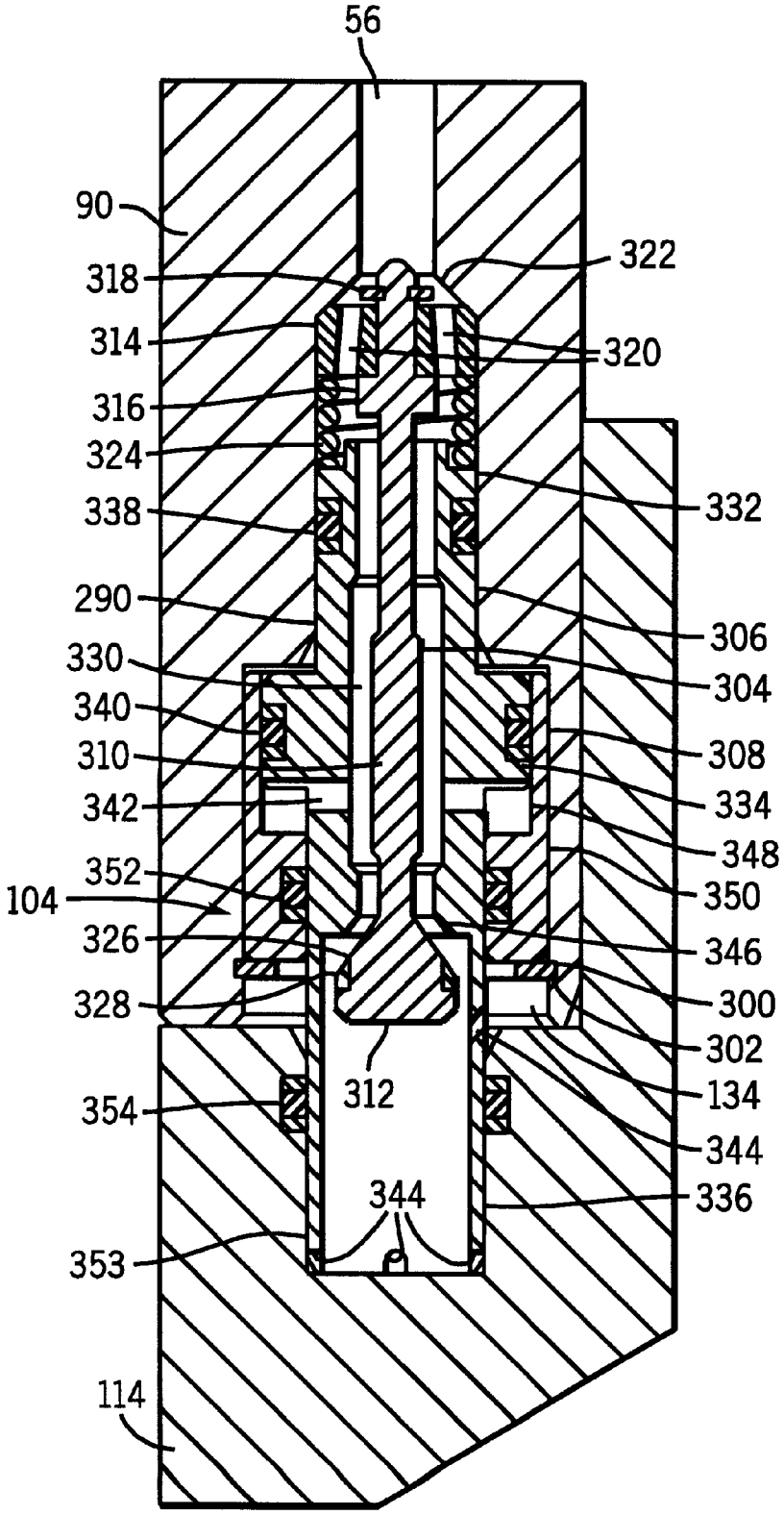
FIG. 7 is a vertical sectional view of a mechanically opened check valve for forcing release of the assembly shown in FIG. 2 in accordance with certain aspects of the present technique.

Turning now to a presently preferred construction of valve 104, FIGS. 7–12 illustrate presently preferred configurations of a valve for releasing the components of the connector assemblies described above. As shown in FIG. 7, valve 104 is lodged within recess 290 of manifold 90, and is held within the manifold by a retainer ring 300 secured within a groove 302. Valve 104 generally includes a spool-type valve member 304, a seat member 306 surrounding valve member 304, and a seat housing 308 surrounding a portion of seat member 306. Both valve member 304 and seat member 306 are movable, as described below, to permit the flow of fluid through the valve, and to open and close the valve selectively for normal and release operations. Moreover, member 308 is also preferably slightly movable within the valve to permit the equalization of forces within the valve assembly.

Referring more particularly now to a preferred construction of valve member 304, member 304 includes an elongated spool 310. Spool 310 has a seat portion 312 at its lower end, and a valve stop 314 at its upper end. Valve stop 314 is held in place by an annular extension 316, and a retainer ring 318. Moreover, valve stop 314 includes flow-through apertures 320 permitting fluid to flow through the stop during operation of the valve. Valve stop 314 is positioned adjacent to an upper end 322 of recess 290 as described below. At its lower side, valve stop 314 abuts a compression spring 324 which serves to bias both the valve member 304 and the seat member 306 toward mutually sealed positions. In the illustrated embodiment, seat portion 312 includes a tapered hard metallic seat surface 326, as well as a soft elastomeric seat 328 secured in an annular position to provide sealing during a portion of the movement cycle of the valve components. This arrangement provided redundancy in the sealing of the valve member and seat member.

Seat member 306 includes an elongated fluid passageway 330 in which spool 310 is disposed. Moreover, along its length, seat member 306 forms an upper extension 332, an enlarged central section 334, and a lower actuating extension 336. Seals are carried by the scat member to seal designated portions of the volumes of the valve. In the illustrated embodiment these seals include an upper T-seal 338 disposed about upper section 332, and an intermediate T-seal 340 disposed about central section 332. Upper T-seal 338 seals between the seat member and recess 290. Intermediate T-seal 340 seals between the seat member and an internal surface of seat housing 306 as described more fully below. Fluid passageways 342 are formed in seat member 306 to place an outer periphery of the seat member in fluid communication with passageway 330. In the release valve, additional passageways 344 are formed at the base of actuating extension 336. A lower seat surface 346 is formed to contact hard and soft sealing surfaces 326 and 328 to prevent flow through the value upon closure.

Seat housing 308 is positioned intermediate recess 290 and seat member 306. In the illustrated embodiment, seat housing 308 includes an enlarged bore 348 in which central section 334 of seat member 306 is free to slide. T-seal 340 seals central section 334 in its sliding movement within bore 348. Seat housing 308 also includes a reduced diameter lower portion 350 surrounding actuating extension 336 of seat member 306. An internal T-seal 352 is provided in lower portion 350 to seal against the actuating extension. Retaining ring 300 abuts lower portion 350 to maintain the seat housing in place. Below seat housing 308, within lower recess 353, a similar internal T-seal 354 is provided for sealing about actuating extension 336. As described below, in certain applications such as when the valve is used for hydraulic release, seal 354 may be omitted, particularly where sealing between the actuating extension and the lower recess is not required. In the present embodiment no seal 354 is provided in the release valve to permit pressurized fluid access pressure chamber 134.

In the embodiment illustrated in FIG. 7, lower recess 353 is blind, and is configured to receive actuating extension 336 of valve 104. In the installed position shown in FIG. 7, manifold 90 is fully engaged in lower connector assembly 114, such that actuating extension 336 contacts a lower end of recess 353 to force seat member 306 into an upper position along seat housing 308. The upward movement of seat member 306 compresses spring 324 to force valve member 304 into an upper position. A free flow path is thereby defined through control line 56, apertures 320 in valve stop 314, inner passageway 330, and downwardly around seat portion 312 of the valve spool. At the same time, pressure from the passageway 330 of seat member 306 is communicated to the region between central section 334 of the seat member and the lower portion 350 of the seat housing via passageways 342. Moreover, when the valve is used for hydraulic release the lower volume defined within actuating extension 334 below the spool is in fluid communication with pressure chamber 134 below seat housing 308. It should be noted that when the valve is mechanically held open, fluid may be permitted to flow in either direction through the valve.

Figure 8:
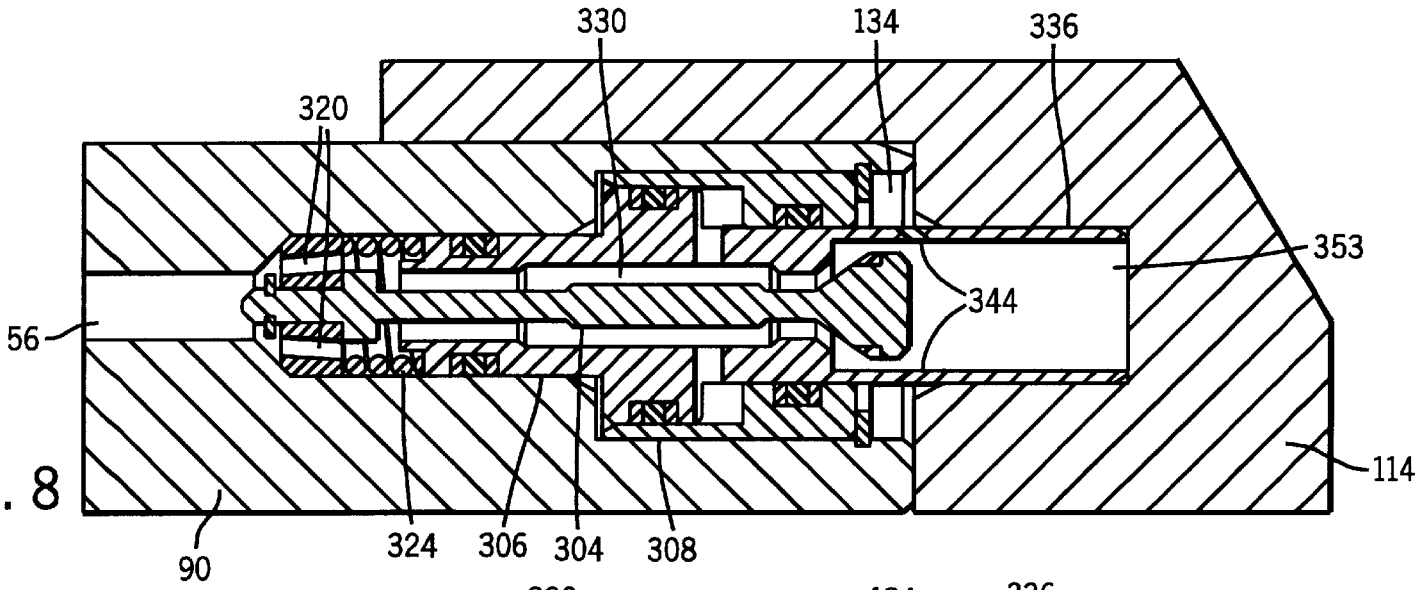
FIG. 8 is a sectional view of the valve of FIG. 7 illustrated in the installed position.
Figure 9:
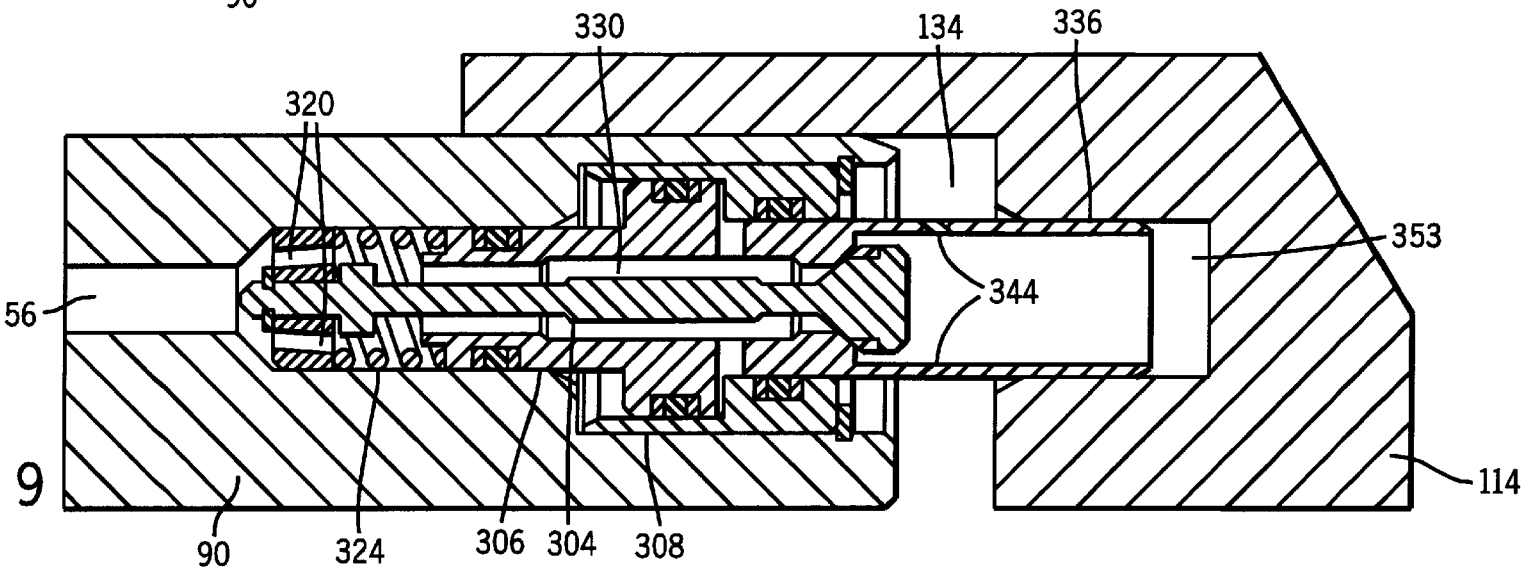
FIG. 9 is a sectional view of the valve of FIG. 7 following partial release of the assembly.

Referring now to FIG. 8, for actuation of the valve, and release of the portions of the assembly from one another, pressure is applied at control line 56 such as via an aboveground pressure source. This pressure is transmitted through apertures 320, through passageway 330, into actuating extension 336, and thereby into pressure chamber 134. As the pressure increases, a parting force is exerted against areas adjacent to pressure chamber 134. At this time, all valve components are in pressure equilibrium. The valve assembly and manifold 90 are thereby forced away from lower connector assembly 114, as illustrated in FIG. 9. Spring 324 will bias the valve member 304 to contact seat member 306.

Following initial parting of the assembly members, valve member 304 will seat against seat member 306 as shown in FIG. 9. Application of additional pressurized fluid within control line 56 will force the fluid through central passageway 330, temporarily unseating the spool by relative movement of the valve member 304 and seat member 306 (within the valve recess), resulting in progressive displacement of the manifold in an upward direction under the influence of forces exerted against surfaces adjacent to pressure chamber 134. As noted above, in the blind arrangement shown in FIGS. 7 through 11, T-seal 354 may be eliminated, due to the free communication of fluid between the actuating extension 336 and pressure chamber 134.

Figure 10:
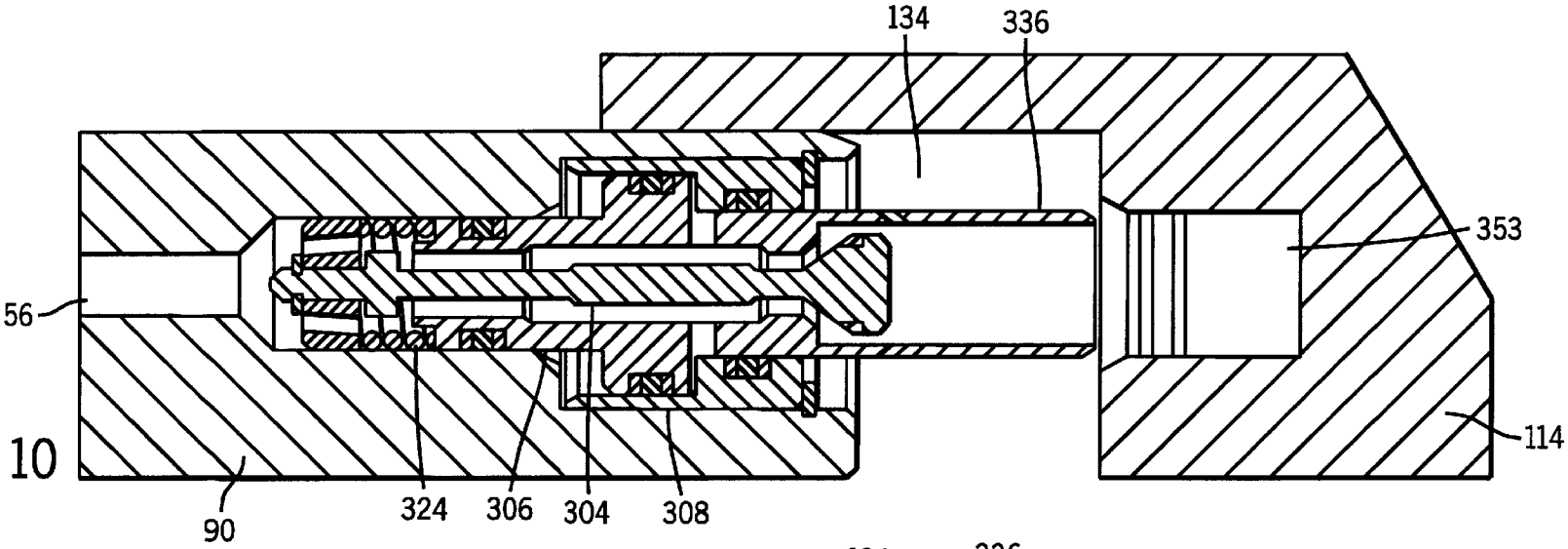
FIG. 10 is a sectional view of the valve of FIG. 7 following full release of the assembly, and with a positive pressure on the valve to purge the hydraulic supply line.
Figure 11:
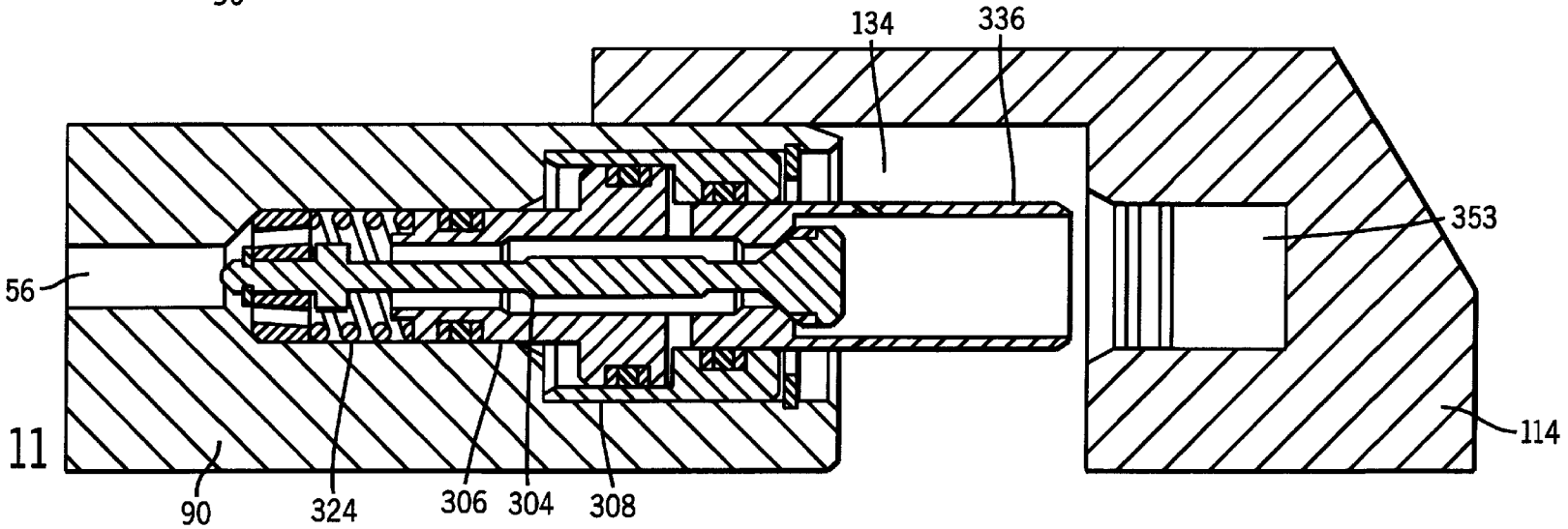
FIG. 11 is a sectional view of the valve of FIG. 7 following release of the purge pressure to permit the valve to reseat.

The progressive displacement of the sections of the assembly with respect to one another may proceed under fluid pressure exerted through valve 104 until full disengagement of actuating extension 336 is obtained as shown in FIG. 10. Thereafter, further application of fluid pressure through the valve continues to unseat valve member 304 from seat member 306, and seat member 306 from seat housing 308, to progressively disengage the assembly sections from one another, thereby disconnecting conductors as explained above. Alternatively, once pins 119 or similar controlled release structures are sheared or actuated, the upper and lower connector sections may be separated by relative movement of the completion equipment and the deployment system. Following such full disengagement of the valve from its lower recess, valve 104 will seat as illustrated in FIG. 11.

Following full disengagement of the sections of the assembly, valve 104 serves as a check valve permitting purging of fluids which may infiltrate into control line 56. In particular, as shown in FIGS. 10 and 11, pressure may be exerted in control line 56 to unseat the valve member and seat member from one another, permitting such purging action. Following reduction in the pressure at control line 56, spring 324 and pressure surrounding valve member 304, force the valve member and seat member into seated engagement with one another. It should be noted that in the present embodiment illustrated in the figures, clearance is provided between valve stop 314 and upper end 322 of recess 290, to permit full seating of the valve and seat member on one another when connector components are separated as shown in FIG. 11.

Figure 12:
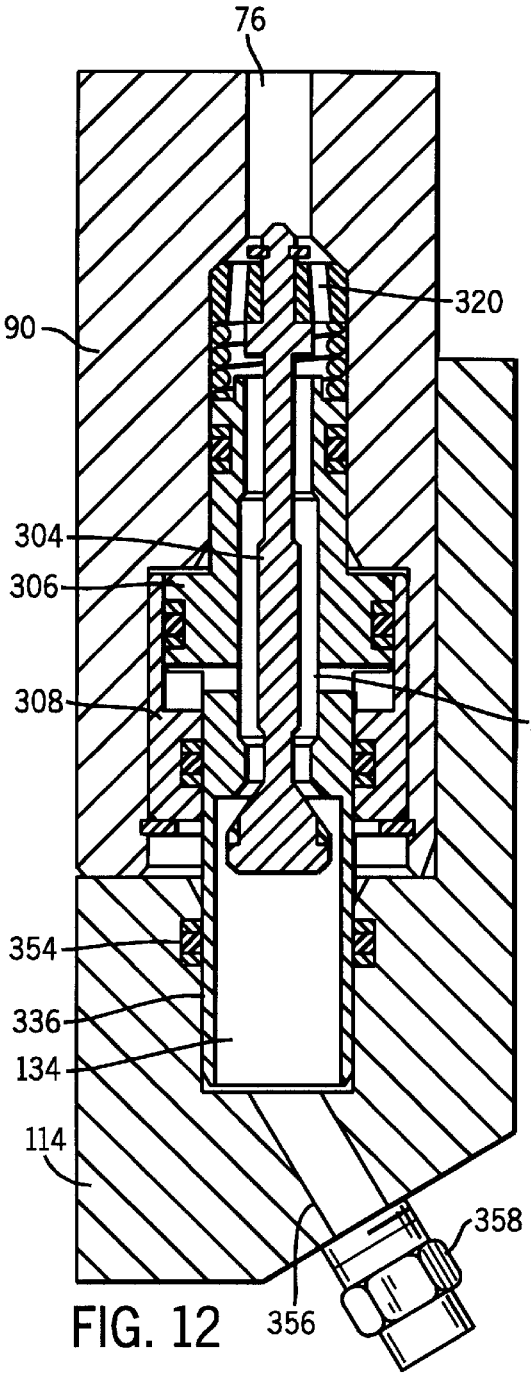
FIG. 12 is a sectional view of the valve of FIG. 7 adapted for transmission of fluid to a downstream component.

Various adaptations may be made to valve 104 to permit control lines, instrument lines, and so forth, to communicate between upper and lower portions of the connector assembly, while preventing flooding of such lines upon parting or release. FIG. 12 illustrates one such adaptation incorporated into a valve of the basic structure described above. In particular, rather than the blind cavity described above used to force separation or release of the connector assembly, a fluid passageway or conduit 356 may be formed in communication with the lower fluid volume within actuating extension 336. In the embodiment shown in FIG. 12, a sealed fitting 358 is provided for transmitting fluid to or from a lower component, such as a packer, slide valve, and so forth. In such arrangements, full engagement of the valve 104 during assembly of the connector system will define a flow path permitting the free exchange of fluid between manifold 90 and the lower component. Upon parting, however, T-seal 354 will prevent the exchange of pressurized fluid between pressure chamber 134 and fluid contained within the valve. It should be noted that in this embodiment, actuating extension 336 does not require fluid passageways 344 (refer to FIG. 7), but where such passageways are present, T-seal 354 prevents the exchange of fluids between the control line and pressure chamber 134. Upon full release of the connector assembly portions, the valve will seat, thereby preventing the flow of well bore fluids, water or other ambient fluids into line 76. As is described above, pressure applied as line 76 of such valves will, however, permit purging of the feed lines.

Figure 13:
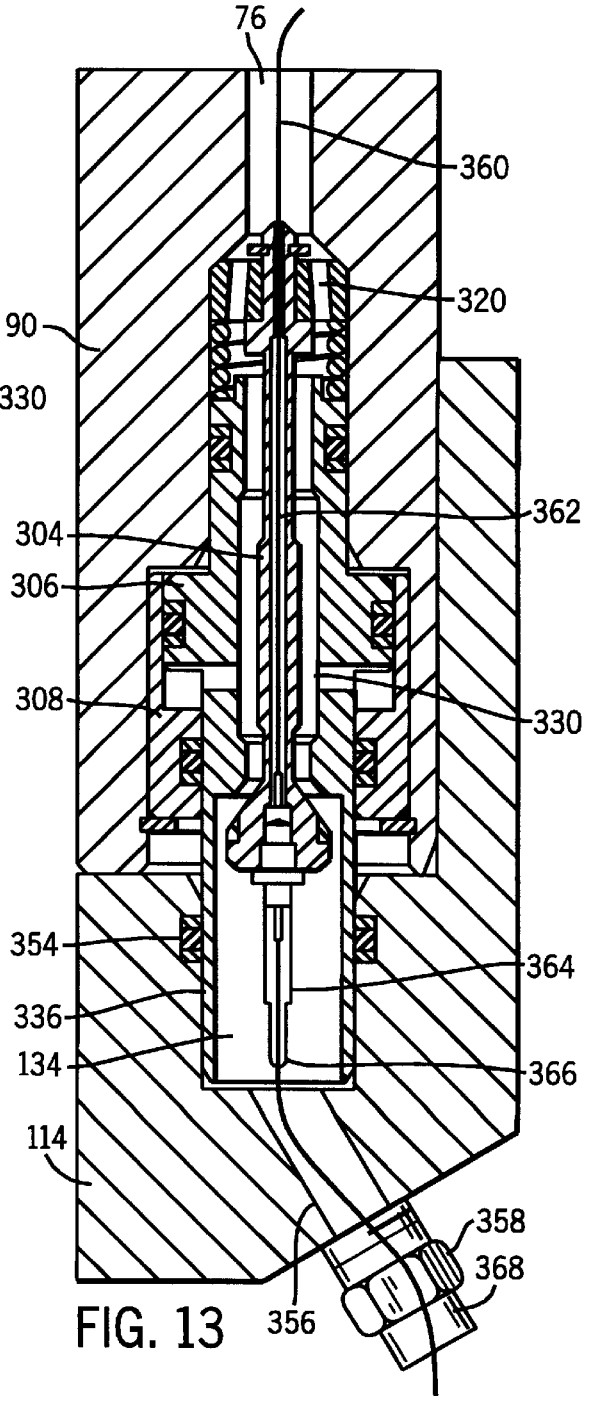
FIG. 13 is a sectional view of the valve of FIG. 7 adapted for exchange of data or power signals with a downstream component.

Also shown in FIG. 13, valve 104 may be adapted for accommodating an integral electrical conductor 360, such as for a gauge pack or other electrical device. In this adaptation, a central bore 362 is formed through valve member 304. Conductor 360 is fed through bore 362 and terminates in a bulkhead feed-through electrical connector 364. In the illustrated embodiment, connector 364 includes a wire plug connection 366. Such connector arrangements are available in various forms and configurations as will be apparent to those skilled in the art. For instance, one acceptable connector is available commercially from Kemlon, an affiliate of Keystone Engineering Company of Houston, Tex., under the commercial designation K25. Other connector arrangements may include bulkhead connectors configured to prevent flooding of the conduits. Also, coaxial, multi-pin, wet-connectable, and other connectors may be employed to insure continuity of the electrical connection through valve 104.

In a presently preferred configuration, conductor 360 extends through the valve and is in electrical connection with a tubing encapsulated conductor 368. As in the previous embodiments, valve 104 establishes a flow path upon full engagement of manifold 90 within the assembly. In the case of the valve illustrated in FIG. 12 equipped with an electrical conductor, the electrical conductor may be surrounded by a dialectric fluid medium, such as transformer oil. Alternatively, a sealed contact may be employed to provide a wet-connect arrangement. As the manifold is retracted from the assembly, the electrical connection is interrupted, and the upper line 78 within which the upper conductor 360 is located is closed by operation of the valve. Thereafter, the conductor is electrically isolated by the dialectric fluid within the passageway. As before, the passageway may be purged by exertion of fluid pressure within the passageway to unseat valve member 304 and seat member 306 from one another.

It will be understood that the foregoing description is of preferred embodiments of this invention, and that the invention is not limited to the specific form shown. For example, a variety of connector components can be used in constructing the connector; one or more control lines can be added; a variety of control lines, such as fluid control lines, optical fibers, and conductive control lines can be adapted for engagement and disengagement; the fluid control lines can be adapted for delivering fluids, such as corrosion inhibitors etc., to the various components of the completion; and the power cable can be routed through coil tubing or connected along the coil tubing or other deployment systems. Also, a variety of valve configurations may be employed for initial and progressive, controlled release. For example, various seals may be employed in the valve in place of the T-seals discussed above, such as metal-to-metal seals, cup seals, V packing, poly-seals and so forth. Similarly, data or power signals may be exchanged with a component of the completion via internal connections other than the plug arrangement and feed through valve structure described above. These and other modifications may be made in the design and arrangement of the elements without departing from the scope of the invention as expressed in the appended claims.

What is claimed is:

1. A system for connecting a submergible pumping system to a deployment system and for selectively releasing the submergible pumping system from the deployment system, comprising:

a submergible pumping system;

a coil tubing deployment system comprising:

a coil tubing; and a power cable disposed within the coil tubing to supply power to operate the submergible pumping system; and a connector connecting the coil tubing deployment system with the submergible pumping system, the connector having:

an upper connector assembly;

a lower connector assembly attached to the upper connector assembly; and a separator mechanism that may be remotely actuated to separate the upper connector assembly from the lower connector assembly.

2. The apparatus as recited in claim 1, wherein the separator mechanism comprises a hydraulic line disposed through the upper connector assembly and a discharge area on the lower connector for receiving pressurized hydraulic fluid from the hydraulic line.

3. The apparatus as recited in claim 2, further comprising a shear pin connecting the upper connector assembly to the lower connector assembly.

4. The apparatus as recited in claim 3, further comprising a valve coupled to the hydraulic line to prevent backflow into the hydraulic line upon separation of the upper connector assembly from the lower connector assembly.

5. The apparatus as recited in claim 4, further comprising a hydraulic manifold disposed in the upper connector assembly and including a recess for receiving the valve.

6. The apparatus as recited in claim 5, further comprising a second hydraulic line disposed through the manifold and a second valve coupled to the second hydraulic line.

7. The apparatus as recited in claim 6, further comprising a third hydraulic line disposed through the manifold and a third valve coupled to the third hydraulic line.

8. The apparatus as recited in claim 1, further comprising a plurality of shear pins connecting the upper connector assembly to the lower connector assembly.

9. The apparatus as recited in claim 1, further comprising a plurality of motor conductors that extend through a plug, the plug being separable and having a first plug portion disposed in the upper connector assembly and a second plug portion disposed in the lower connector assembly.

10. A system for connecting a submergible pumping system to a deployment system and for selectively releasing the submergible pumping system from the deployment system, comprising:

a coil tubing deployment system;

a downhole completion; and a connector connecting the coil tubing deployment system with the downhole completion, the connector having:

an upper connector assembly;

a lower connector assembly;

a shear pin connecting the upper connector assembly to the lower connector assembly; and a separator mechanism that may be remotely actuated to separate the upper connector assembly from the lower connector assembly, wherein the separator mechanism comprises a hydraulic line disposed through the upper connector assembly and a discharge area on the lower connector for receiving pressurized hydraulic fluid from the hydraulic line.

11. The apparatus as recited in claim 10, further comprising a valve coupled to the hydraulic line to prevent backflow into the hydraulic line upon separation of the upper connector assembly from the lower connector assembly.

12. The apparatus as recited in claim 11, further comprising a hydraulic manifold disposed in the upper connector assembly and including a recess for receiving the valve.

13. The apparatus as recited in claim 12, further comprising a second hydraulic line disposed through the manifold and a second valve coupled to the second hydraulic line.

14. The apparatus as recited in claim 13, further comprising a third hydraulic line disposed through the manifold and a third valve coupled to the third hydraulic line.

15. A system for connecting a submergible pumping system to a deployment system and for selectively releasing the submergible pumping system from the deployment system, comprising:

a coil tubing deployment system;

a downhole completion; and a connector connecting the coil tubing deployment system with the downhole completion, the connector having:

an upper connector assembly;

a lower connector assembly attached to the upper connector assembly;

a plurality of motor conductors that extend through a plug, the plug being separable and having a first plug portion disposed in the upper connector assembly and a second plug portion disposed in the lower connector assembly; and a separator mechanism that may be remotely actuated to separate the upper connector assembly from the lower connector assembly, wherein the separator mechanism comprises a hydraulic line disposed through the upper connector assembly and a discharge area on the lower connector for receiving pressurized hydraulic fluid from the hydraulic line.

* * * * *